US007827756B2

(12) United States Patent
Kester

(10) Patent No.: US 7,827,756 B2
(45) Date of Patent: Nov. 9, 2010

(54) METAL STUD FOR A WALL OR ROOF SYSTEM

(76) Inventor: Jeff Kester, 3606 N. 270th St., Waterloo, NE (US) 68069

( * ) Notice: Subject to any disclaimer, the term of this patent is extended or adjusted under 35 U.S.C. 154(b) by 203 days.

(21) Appl. No.: 12/220,053

(22) Filed: Jul. 21, 2008

(65) Prior Publication Data

US 2010/0011704 A1 Jan. 21, 2010

(51) Int. Cl.
*E04H 12/00* (2006.01)

(52) U.S. Cl. ..... 52/653.1; 52/655.1

(58) Field of Classification Search ..... 52/653.1, 52/655.1, 846

See application file for complete search history.

(56) References Cited

U.S. PATENT DOCUMENTS 1,867,449 A * 7/1932 Ecket ..... 52/100
3,209,869 A * 10/1965 Hammitt ..... 403/252
3,680,271 A 8/1972 Satchell
4,793,113 A 12/1988 Bodnar
4,805,364 A 2/1989 Smolik
6,374,558 B1 4/2002 Surowiecki
6,523,322 B1 2/2003 Michalski et al.
RE39,462 E 1/2007 Brady
7,299,593 B1 11/2007 diGirolamo et al.
2007/0033884 A1 * 2/2007 Wright ..... 52/98

* cited by examiner

*Primary Examiner*—Jeanette E Chapman
*Assistant Examiner*—Daniel Kenny
(74) *Attorney, Agent, or Firm*—Dennis L. Thomte; Thomte Patent Law Office LLC

(57) ABSTRACT

A metal stud for use in a metal building wherein the studs are secured to horizontally extending and vertically spaced-apart girts which are either C-shaped or Z-shaped. A metal stud is generally C-shaped and includes a base wall portion and opposite side wall portions with upper and lower ends. The lower ends of the side wall portions each have slot formed therein wherein which are adapted to receive a wall portion and flange of a girt. The upper end of the stud has a tab which extends upwardly therefrom to enable the tab to be secured to a girt. The stud may also be used in the roof system of the building.

5 Claims, 6 Drawing Sheets

METAL STUD FOR A WALL OR ROOF SYSTEM

BACKGROUND OF THE INVENTION

1. Field of the Invention

This invention relates to a metal stud for a wall system and more particularly relates to a metal stud for use in the wall system of a metal building with the studs being positioned between and secured to horizontally extending and vertically spaced girts which are secured to and which extend between vertically disposed posts or columns. The studs of this invention may also be used in the roof system of the metal building.

2. Description of the Related Art

In the construction of metal buildings, a plurality of vertically disposed posts or columns are secured to a foundation and have rafter members secured to the upper ends thereof which extend across the roof of the building for supporting a roof structure thereon. A plurality of horizontally extending and vertically spaced girts are secured to the posts and extend therebetween. An exterior wall structure is normally secured to the outer sides or ends of the girts with insulation being positioned between the girts and posts. If the inside walls of the building are to be finished with dry wall or the like, it is necessary to position vertically disposed metal studs between the girts so that the dry wall sheet members may be secured thereto. In the past, conventional 8' or 10' steel studs were cut-to-length at the job site so that they could be positioned between the girts. Since the vertical spacing of the girts varies within the building, much wastage of material from the steel studs, which are cut-to-length, results. If the inside of the roof is to be finished, metal studs are cut to length so as to fit between the purlins of the roof system which results in wastage of material.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A metal stud for a wall or roof system is disclosed comprising an elongated, generally C-shaped stud member having upper and lower ends with the stud member including a base wall portion having first and second side edges, a first side wall portion extending generally transversely from the first side edge of the base wall portion, and a second side wall portion extending generally transversely from the second side edge of the base wall portion.

The upper end of the base wall portion dwells in a plane above the upper ends of the side wall portions thereof. The lower end of the base wall portion dwells in a plane above the lower ends of the side wall portions thereof. Each of the side wall portions of the stud member have an elongated slot formed therein which extends upwardly thereinto from the lower end of the associated side wall portion adjacent the base wall portion. An enlarged slot portion is formed in the associated side wall portion at the upper end of the elongated slot and which communicates therewith.

The elongated slots are sized so as to receive either the vertically extending wall portion of a C-shaped girt or the vertically extending wall portion of a Z-shaped girt. The enlarged slot portions are sized so as to receive the angled flange of a Z-shaped girt or the transversely extending flange of a C-shaped girt.

The wall system utilizing the stud members of this invention is also disclosed with the wall system including at least first and second vertically disposed and horizontally spaced-apart posts having upper and lower ends and wherein at least upper and lower horizontally extending and vertically spaced girts are secured to the first and second posts and extend therebetween. Each of the girts have a vertically disposed inner wall portion and a flange extending from the upper end thereof. The metal stud members of this invention are secured to and extend between the upper and lower girts in a horizontally spaced-apart manner with each of the stud members being generally C-shaped. The elongated slot receives a portion of the enlarged slot portions receive the inner wall portion and a flange of the lower girt. The lower end of the base wall portion of the stud is secured to the vertically disposed inner wall portion of the lower girt. The upper end of the base wall portion of the stud member is secured to the vertically disposed inner wall portion of the upper girt.

The described stud may also be used when the inside of the roof system is to be finished. In that case, the metal studs are secured to the spaced-apart roof purlins.

It is therefore a principal of the invention is to provide a metal stud for a wall or roof system.

A further object of the invention is to provide a metal stud for use in a metal building and which is secured to and which extends between vertically spaced girts or spaced-apart purlins.

A further object of the invention is to provide a metal stud for a wall or roof system which may be fabricated to length at the factory and then installed at the job site thereby preventing wastage of material as found in the prior art methods of construction.

A further object of the invention is to provide a metal stud for a wall system which is adapted to be used with either girts of either the C-shape or the Z-shape.

Another object of the invention is to provide a metal stud for a wall or roof system which enables drywall sheet members to be secured thereto.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

Figure 1:
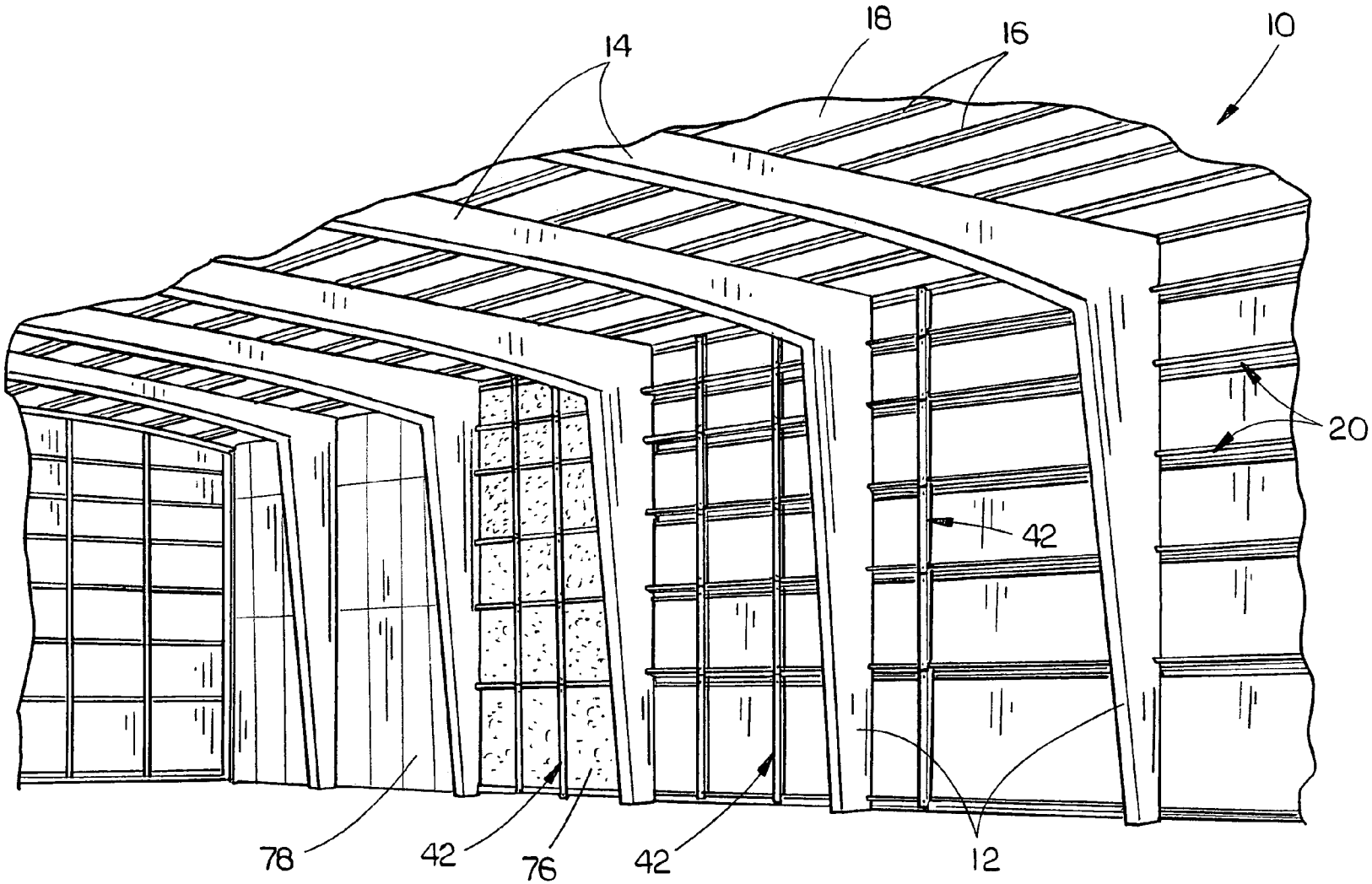
FIG. 1 is a partial inside perspective view of a metal building wherein the metal studs of this invention are positioned and secured to girts.

FIG. 1 illustrates a conventional steel building 10 which includes a plurality of horizontally spaced-apart columns or posts 12 having a plurality of rafter members 14 extending inwardly from the upper ends thereof which extend towards the other side of the building 10 and which are supported by similar columns or posts at the other side of the building. Rafter members 14 and posts 12 may be integrally formed but are usually separate pieces bolted or otherwise secured together. A plurality of roof purlins 16 extend over and between the rafter members 14 in conventional fashion for supporting a roof 18 thereon in conventional fashion.

Figure 4:
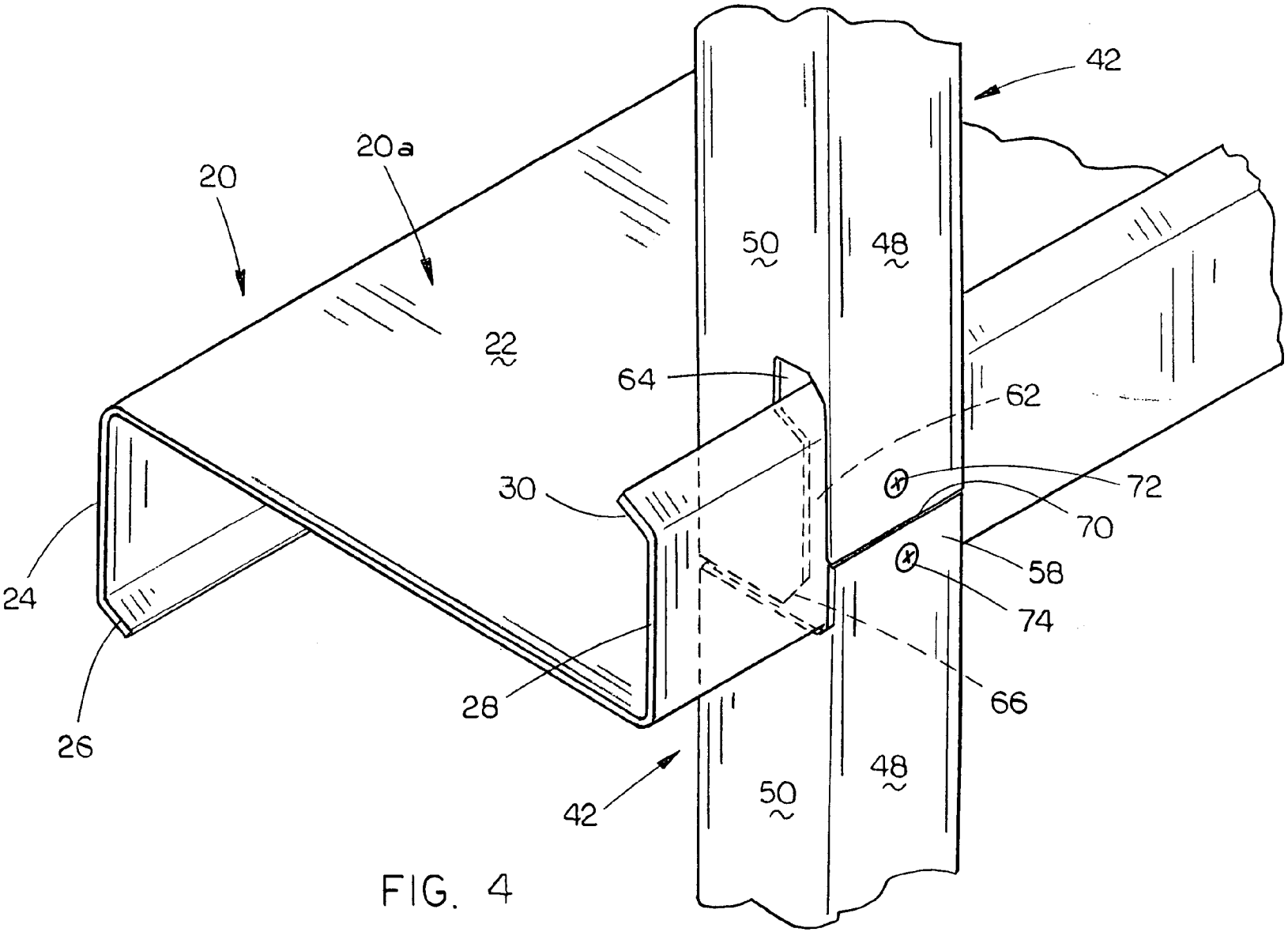
FIG. 4 is a view showing the upper end of a stud member and the lower end of a stud member being secured to a Z-shaped girt.
Figure 5:
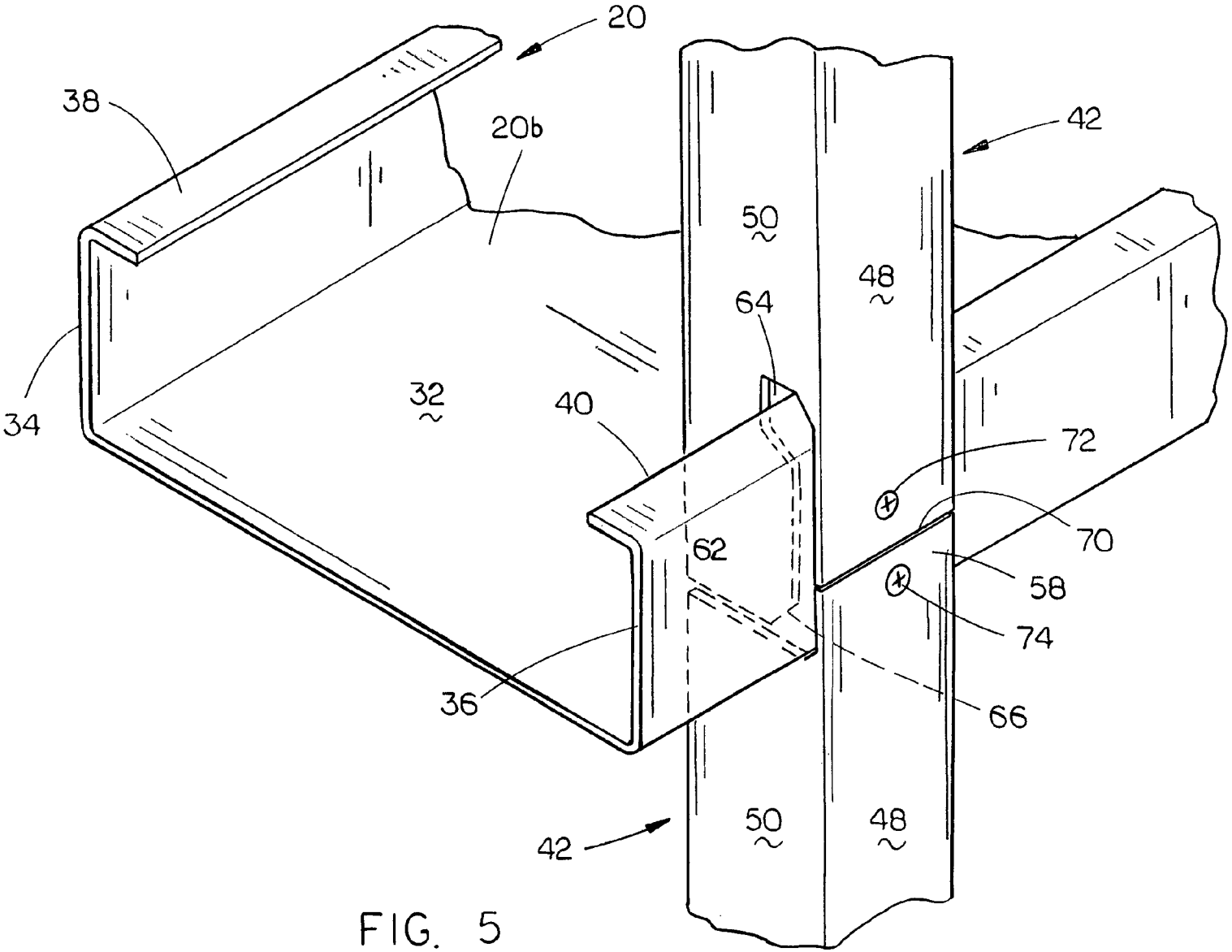
FIG. 5 is a perspective view similar to FIG. 4 except that the girt is C-shaped.
Figure 6:
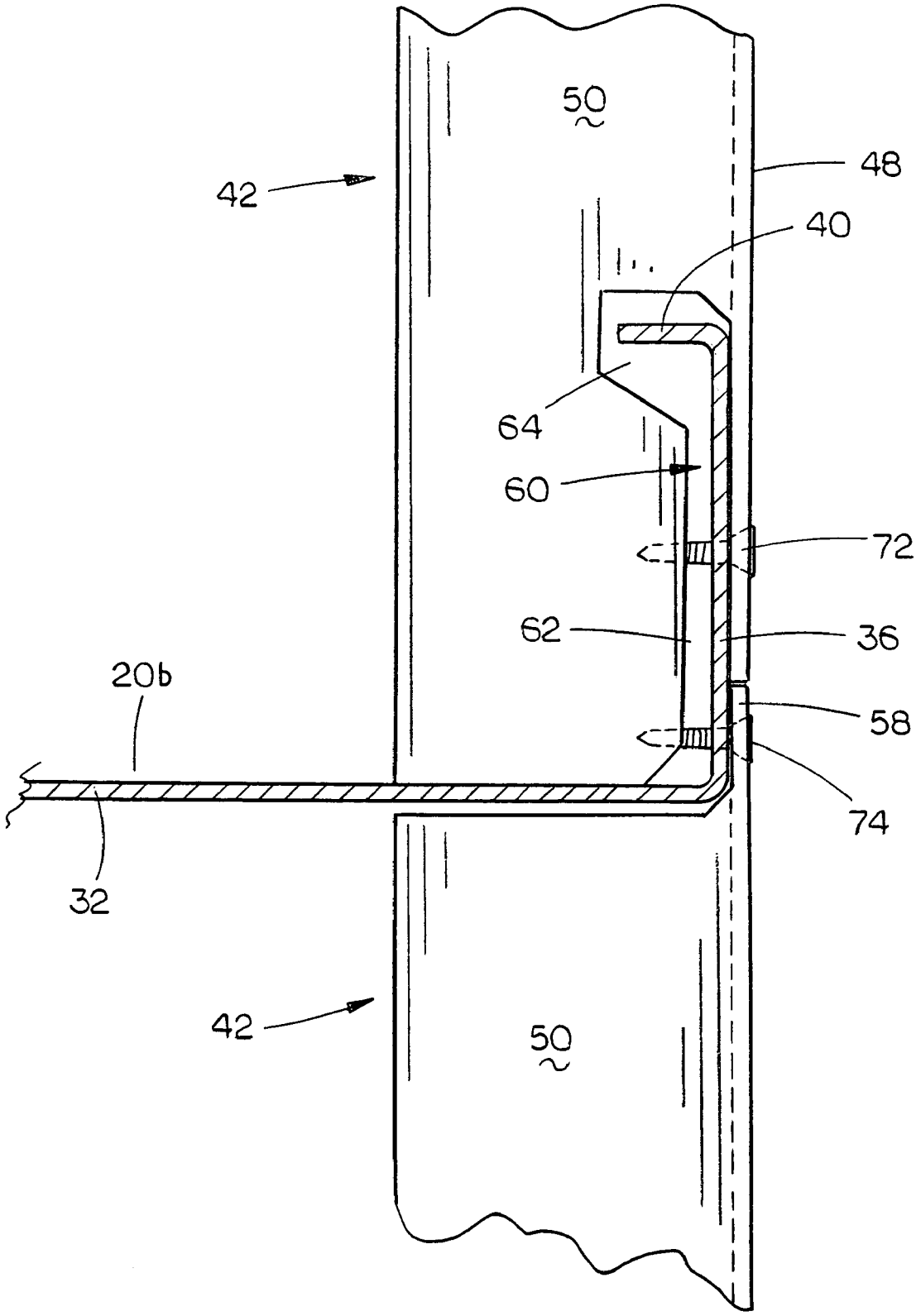
FIG. 6 is a partial sectional view of a structure of FIG. 5 illustrating the connection of the upper and lower stud members with the girt.

A plurality of horizontally extending and vertically spaced girts 20 are secured to and extend inwardly between the posts 12 from the outer sides thereon in conventional fashion. The vertical spacing of the girts 20 usually varies as seen in FIG. 1. The girts 20 may be of the Z-type 20*a* as seen in FIG. 4 or of the C-type 20*b* as seen in FIG. 5. Girt 20*a* includes a top wall portion 22, a downwardly extending outer wall portion 24 which extends downwardly from one side of top wall portion 22, an angled portion 26, an upwardly extending inner wall portion 28 and angled flange 30. As stated, the girt 20 may be of the C-type 20*b* as illustrated in FIG. 5. Girt 20*b* includes a bottom wall portion 32, an upstanding outer wall portion 34, an upstanding inner wall portion 36, horizontally extending flange 38 at the upper end of outer wall portion 34, and horizontally extending flange 40 at the upper end of inner wall portion 36.

If girt 20*a* is used, outer wall portion 24 will be positioned adjacent the outer sides of the associated posts 12 with top wall portion 22 extending inwardly between posts 12 from the outer sides of the associated posts 12.

If girt 20*b* is used, outer wall portion 34 will be positioned adjacent the outer sides of the associated posts 12 with bottom wall portion 32 extending inwardly between the posts 12 from the outer sides of the associated posts 12.

If the inside walls of the building are to be finished with drywall or sheet rock members, 8' or 10' steel studs would normally be cut to length on the job site so as to extend between the vertically spaced girts 20, the spacing of which will vary within the building. The need to cut the 8' or 10' studs to length will result in considerable wastage of material. The cut-to-length studs will be secured to the vertically spaced girts 20 so that drywall sheets may be secured to the inner wall portions of the cut-to-length studs.

The instant invention is designed to prevent the extreme waste of materials which is caused by the requirement that conventional 8' or 10' steel studs be cut-to-length at the job site and then secured to the girts 20 to provide a mounting surface for the drywall sheets. The problems associated with the prior art are solved by utilizing the metal, preferably steel, studs 42 which will be formed at the factory so as to have the prescribed length so as to fit between the girts 20, which will vary but which will be set forth in the specifications of the building.

Each of the studs 42 is generally C-shaped in cross-section and including an upper end 44 and a lower end 46. Stud 42 includes an inner wall portion 48, spaced-apart side wall portions 50 and 52 with transversely extending flanges 54 and 56 respectively. The upper end 44 of stud 42 is provided with an upwardly extending tab 58. The lower ends of each of the side wall portions 50 and 52 are provided a slot 60 formed therein which includes a vertically disposed slot portion 62 and an enlarged slot portion 64 at the upper end of slot portion 62.

Figure 2:
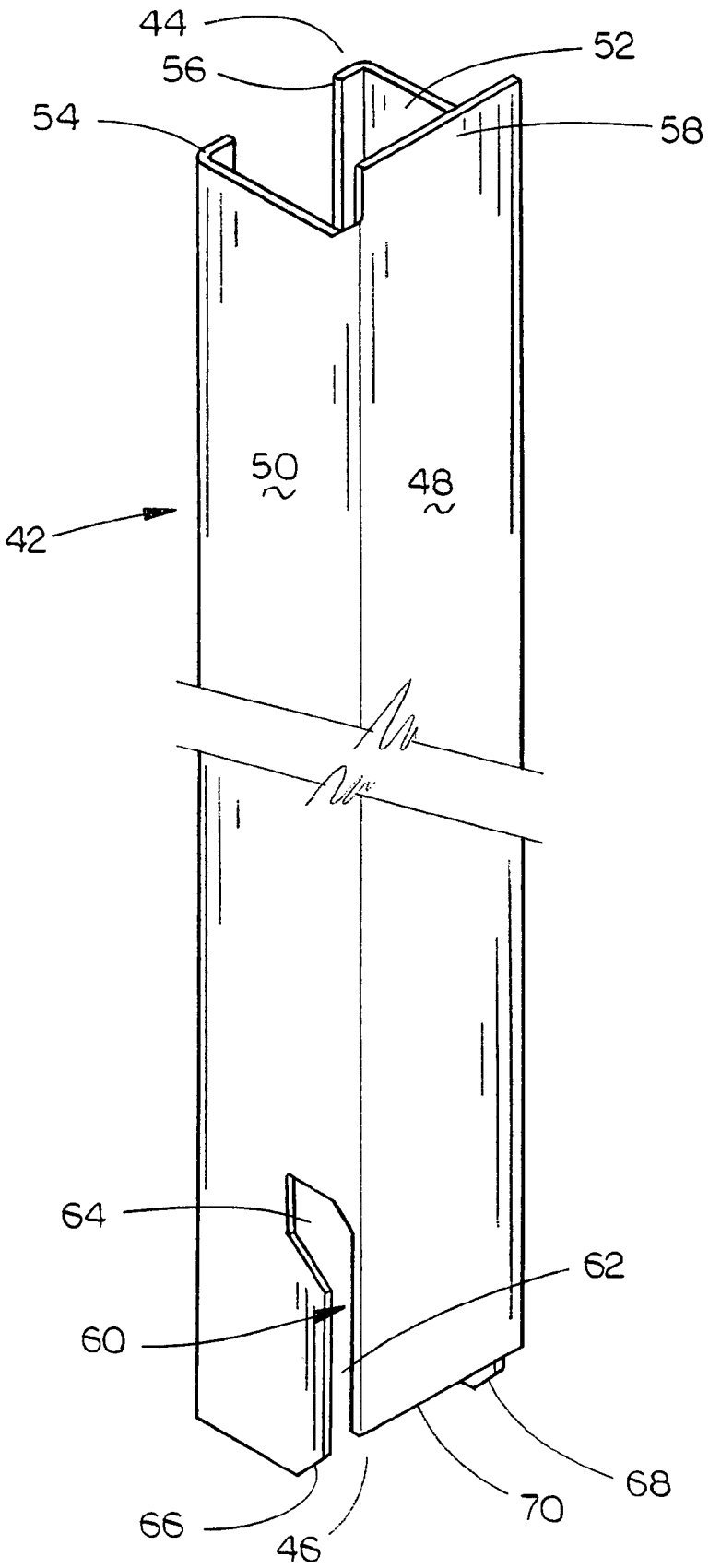
FIG. 2 is a partial perspective view of the metal stud of this invention.

As seen in FIG. 2, the lower inner ends of side wall portion 50 and 52 of stud 42 are beveled at 66 and 68 respectively. As also seen in FIG. 2, the wall portion 48 has a lower edge 70 which is spaced above the lower edges of wall portions 50 and 52.

During the design of the building 10, the specifications thereof will identify the vertical spacings of the girts which will normally vary as seen in FIG. 1. If the interior of the building is to be finished with drywall or sheet rock, the contractor will order sufficient studs 42 having particular lengths.

The studs 42 will be fabricated at the factory or could even be fabricated at the building site. The design of the studs 42 is such that they may be used with either girts 20*a* or 20*b*.

Figure 3:
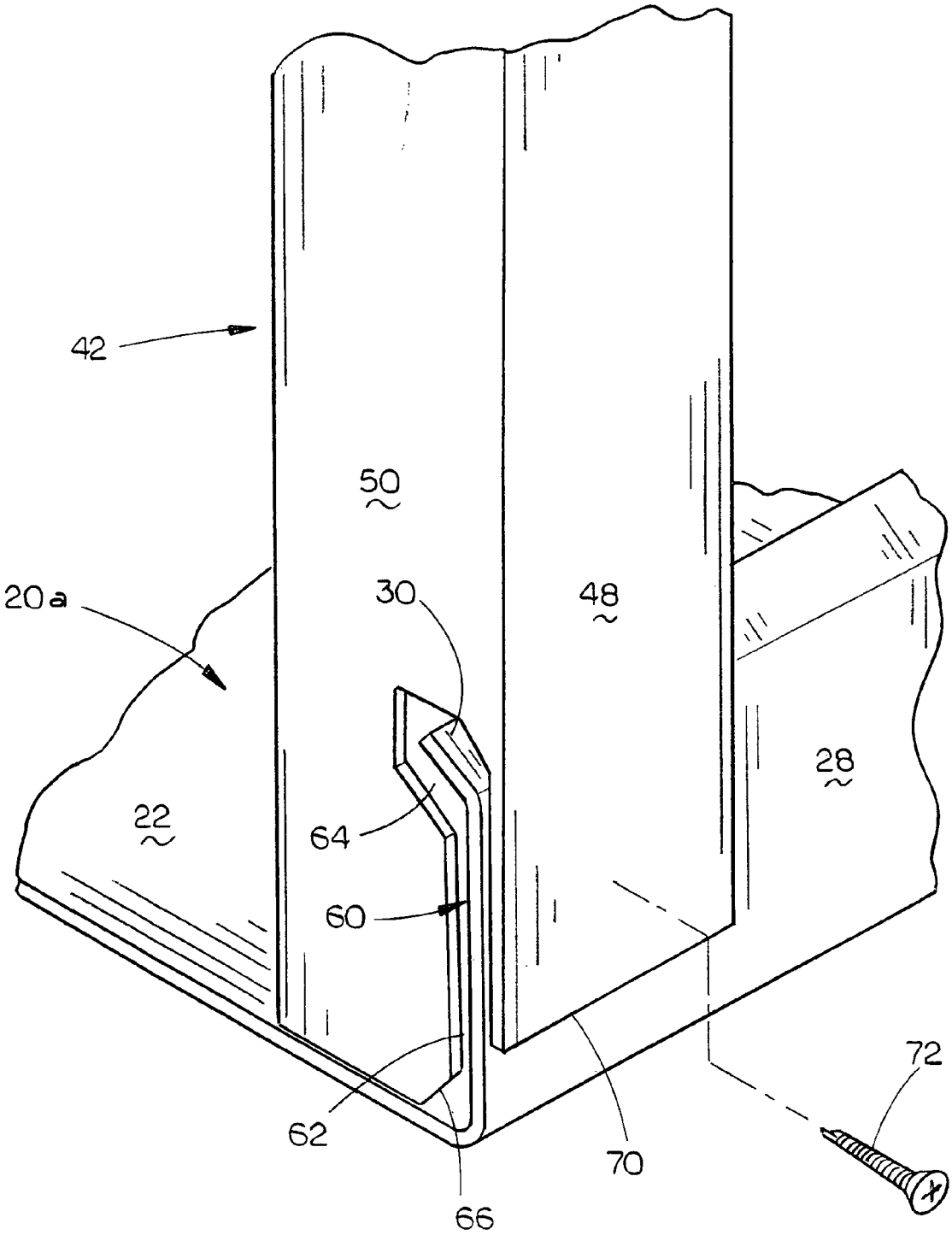
FIG. 3 is a partial perspective view illustrating the lower end of the stud member being secured to a Z-shaped girt.

Once the building has been erected so that the posts or columns 12, rafter members 14 and girts 20 are in place, the studs 42 will be secured to the vertically spaced girts 20 as will now be described. Assuming that the studs 42 will be installed starting from the lowermost girt and working upwardly therefrom and that the girts are of the 20*a* type, the lower end of a stud 42 will be slipped downwardly onto the inner end of a girt 20*a* so that the inner wall 28 and flange 30 are received by the slot 60 in wall portion 50 and slot 60 in wall portions 52 with the lower ends of wall portions 50 and 52 resting on the upper surface of bottom wall portion 22 and with the lower edge 70 of wall portion 48 dwelling in a plane above bottom wall portion 22. The enlarged slot portion 64 receives the flange 30 as seen in FIG. 3. A self-tapping screw 72 is then driven into wall portion 48 adjacent the lower end thereof and driven into wall portion 28 of girt 20*a*. At that time, the upper end of the stud 42 will have been positioned with respect to a girt 20*a* which is positioned above the lower girt 20*a* as seen in FIG. 4. A self-tapping screw 74 is then driven into the tab portion 58 of stud 42 and into the wall portion 28 of the girt 20*a*. another stud 42 will then be mounted on and secured to the girt 20*a* as seen in FIG. 4 with the lower edge 70 of the upper stud 42 being positioned adjacent the upper edge of the tab portion 58 of the lower stud 42.

The process is continued until all the studs are in place at which time insulation 76 may be placed between the studs 42 and girts 20 as seen in FIG. 1. Sheets 78 of drywall material may then be secured to the wall portions 48 of the studs 42 by self-tapping screws or the like.

The studs 42 may also be used with the girts 20*b* in the same manner as just described inasmuch as the enlarged slot portion 64 of slot 60 will accommodate flange 40 of girt 20*b* as seen in FIG. 5.

The metal studs 42 may also be secured to the roof purlins 16 so as to extend therebetween to enable the inside of the roof system to be finished.

Thus, it can be seen that a novel metal stud 42 has been provided which may be used with C-shaped and Z-shaped girts and which may be fabricated in proper lengths so as to be positioned between and secured to associated girts having various spacings. The studs 42 of the invention eliminate the wastage of material such as occurs when 8' studs or the like must be cut-to-length at the job site. It can therefore be seen that the invention accomplishes at least all of the stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

The invention claimed is:

1. A metal stud for a wall or roof system, comprising:

an elongated, general C-shaped stud member having upper and lower ends;

said stud member including a base wall portion having first and second side edges, a first side wall portion extending generally transversely from said first side edge of said base wall portion, and a second side wall portion extending generally transversely from said second side edge of said base wall portion;

said upper end of said base wall portion dwelling in a plane above the upper ends of said side wall portions;

said lower edge of said base wall portion dwelling in a plane above said lower ends of said side wall portions;

each of said side wall portions having an elongated slot formed therein which extends upwardly thereinto from said lower end of the associated side wall portion adjacent said base wall portion; and an enlarged slot portion formed in the associated side wall portion at the upper end of said elongated slot and which communicates therewith;

said enlarged slot portions being sized so as to receive either an angled flange of a Z-shaped girt or a horizontally extending flange of a C-shaped girt.

2. The metal stud of claim 1 wherein said elongated slots are sized so as to receive a vertically extending wall portion of a Z-shaped girt.

3. The metal stud of claim 1 wherein said elongated slots are sized so as to receive a vertically extending wall portion of a C-shaped girt.

4. The metal stud of claim 1 wherein said elongated slots are sized so as to receive a vertically extending wall portion of either a Z-shaped girt or a C-shaped girt.

5. A wall system, comprising:

at least first and second vertically disposed and horizontally spaced-apart posts having upper and lower ends;

at least upper and lower horizontally extending and vertically spaced girts secured to said first and second posts and extending therebetween;

each of said girts having a vertically disposed wall portion and a flange extending from the upper end thereof;

and a plurality of vertically disposed metal stud members, having upper and lower ends, secured to and extending between said upper and lower girts in a horizontally spaced-apart manner;

each of said stud members being generally C-shaped;

each of said stud members comprising a base wall portion having first and second side edges, a first side wall portion extending generally transversely from said first side edge of said base wall portion, and a second side wall portion extending generally transversely from said second side edge of said base wall portion;

said upper end of said base wall portion dwelling in a plane above the upper ends of said side wall portions;

said lower edge of said base wall portion dwelling in a plane above said lower ends of said side wall portions;

each of said side wall portions having an elongated slot formed therein which extends upwardly thereinto from said lower end of the associated side wall portion adjacent said base wall portion; and an enlarged slot portion formed in the associated side wall portion at the upper end of said elongated slot and which communicates therewith;

said enlarged slot portion receiving said wall portion and said flange of said lower girt;

said lower end of said base wall portion being secured to said vertically disposed wall portion of said lower girt;

said upper end of said base wall portion of said stud member being secured to said vertically disposed wall portion of said upper girt.

* * * * *